US006549633B1

(12) United States Patent
Westermann

(10) Patent No.: US 6,549,633 B1
(45) Date of Patent: Apr. 15, 2003

(54) BINAURAL DIGITAL HEARING AID SYSTEM

(75) Inventor: Søren Erik Westermann, Grønholt (DK)

(73) Assignee: Widex A/S, Vaerlose (DK)

( * ) Notice: Subject to any disclaimer, the term of this patent is extended or adjusted under 35 U.S.C. 154(b) by 0 days.

(21) Appl. No.: 09/486,181

(22) PCT Filed: Feb. 18, 1998

(86) PCT No.: PCT/DK98/00062

§ 371 (c)(1),
(2), (4) Date: Feb. 23, 2000

(87) PCT Pub. No.: WO99/43185

PCT Pub. Date: Aug. 26, 1999

(51) Int. Cl.[7] ..... H04R 25/00

(52) U.S. Cl. ..... 381/312; 381/315; 381/314; 381/320

(58) Field of Search ..... 381/23.1, 312, 381/314, 317, 320, 321, 92, FOR 128, 315, 318

(56) References Cited

U.S. PATENT DOCUMENTS

| | | | | |
|---|---|---|---|---|
| 3,509,289 A | | 4/1970 | Briskey et al. | |
| 4,425,481 A | * | 1/1984 | Mangold et al. | 381/317 |
| 5,479,522 A | * | 12/1995 | Lindemann et al. | 381/312 |
| 5,511,128 A | * | 4/1996 | Lindemann | 381/92 |
| 5,608,803 A | * | 3/1997 | Magotra et al. | 381/312 |
| 5,991,419 A | * | 11/1999 | Brander | 381/312 |

FOREIGN PATENT DOCUMENTS

| | | |
|---|---|---|
| WO | WO 97/14268 | 4/1997 |
| WO | WO 99/34642 | 7/1999 |

* cited by examiner

*Primary Examiner*—Huyen Le
(74) *Attorney, Agent, or Firm*—Sughrue Mion, PLLC

(57) ABSTRACT

In a binaural hearing aid with signal processors in each unit, each signal processor includes a first processor part for hearing compensation processing of signals representing the sound received at that unit, and a second processor part for hearing compensation processing of signals received from the other unit via a communications link.

24 Claims, 3 Drawing Sheets

17
16
18l
19l
A/D
20l
CTRL.
21l
BAND DIVIDER
Compr.
29l
NOISE FILTER
22l
PROCESSOR
23l
OUTPUT PROCESSOR
26l
27l
128l
Comp
24l
BINAUR PROCESSOR
25l
21rs
28l
BAND DIVIDER
NOISE FILTER
22rs
PROCESSOR
23rs
18r
19r
A/D
20r
CTRL.
21r
BAND DIVIDER
Compr.
29r
NOISE FILTER
22r
PROCESSOR
23r
OUTPUT PROCESSOR
26r
27r
128r
Comp
24r
BINAUR PROCESSOR
25r
21ls
28r
BAND DIVIDER
NOISE FILTER
22ls
PROCESSOR
23ls 18r
A/D - PREAMP
19r
LIN. CONTR.
20r
21r
33
SYNCHRONIZE
21ls
BAND DIVIDER
BAND DIVIDER
22r
24r
22ls
NOISE FILTERING
BINAURAL PROCESSING
NOISE FILTERING
23r
23ls
COMPENS. AMPLF.
BINAURAL PROCESSOR
COMPENS. AMPLF.
26r
25r
D/A OUTPUT
30
MEMORY
27r
31
SELECTION
ANALYZER
32

BINAURAL DIGITAL HEARING AID SYSTEM

BACKGROUND OF THE INVENTION

The invention relates to a binaural digital hearing aid system comprising two hearing aid units for arrangement in a user's left and right ear, respectively, each of said units comprising input signal transducer means for conversion of a received input sound signal into an analog input signal, A/D conversion means for conversion of said analog input signal into a digital input signal, digital signal processing means for processing said digital input signal and generating a digital output signal, D/A conversion means for conversion of said digital output signal into an analog output signal and output signal transducer means for conversion of said analog output signal into an output sound signal perceivable to the user, a bidirectional communication link being provided between said units to connect a point in the signal path between the input signal transducer means and the digital signal processing means in one of said units with a corresponding point in the signal path between the input signal transducer means and the digital signal processing means of the other of said units.

For normally hearing persons the ability to localize sounds in space defined as binaural hearing ability is an important part of the sound perception. Typically the amplitude of sound received by the ipsilateral ear which is closer to the source of sound, is of greater amplitude than the sound received by the opposite contralateral ear. This difference in sound level, although often small by itself, is of great importance for a human being's perception of the direction of an incident sound.

In the human hearing system binaural sound perception results from a complicated signal processing of sounds arriving at the left and right side ears, in which time/phase and frequency distribution of the sound plays a decisive role. Thus, time/phase differences and frequency enhancement are important for determining directions in the horizontal and vertical planes, respectively.

With conventional analog hearing aids persons suffering from a binaural hearing impairment, i.e. a hearing loss affecting both ears, the customary practice has been to use two separate hearing aids adjusted to compensate individually for the hearing loss of the respective ear for which the hearing aid is operative and compensation of the loss of binaural sound perception, although typically made even worse by the very use of a hearing aid in both ears, has in most cases by and large been ignored.

As a relatively simple compensation, it has been suggested for each of the two hearing aids of an analog system to use a microphone with a pronounced direction dependent characteristic to provide an analog signal the level of which changes, when the hearing aid is moved from a position pointing towards the sound source to other position with a minimum level, when the hearing aid points in a direction at right angles to the direction to the sound source.

In U.S. Pat. No. 3,509,289 a different concept for compensation of binaural hearing loss in an analog hearing aid system is disclosed involving the use of cross-coupled AGC circuitry for maintaining and enhancing the interaural level difference between contralateral and ipsilateral incident sound. In this system, the gain of each of a first and second amplifying channel is varied inversely with the output of the other channel by separate AGC circuits which are cross-coupled to stabilize the system.

With the introduction of digital signal processing in hearing aids a significant improvement of hearing aid performance has become possible and more advanced proposals for binaural hearing loss compensation have seen the light.

Thus, U.S. Pat. No. 5,479,522 discloses a hearing enhancement system comprising in addition to two hearing aid devices for arrangement in the left and right side ears, respectively, a body-worn pack comprising a remote digital signal processor connected to each of the hearing aid device by a down-link and an up-link for interactive digital processing of the audio signals for each ear based on signals received from both hearing aid devices. The common binaural digital signal processing is predetermined and limited to attenuation of noise and narrowing of the sound field or adapting the signal level in the two channels. The signals supplied to the common binaural signal processing are not affected by the individual hearing loss compensation in the two channels.

In addition, this prior art system reduces the comfort by requiring a separate body-worn signal processor in a addition to the two hearing aid devices and the physical links between the common binaural processor and the two hearing aid devices in the form of radio communications make the system susceptible to distortion affecting the quality of sound reproduction.

In WO 97/14268, a binaural digital hearing aid system is disclosed in which the need for a separate body-worn remote control processor has been eliminated by the use of two hearing aid devices for arrangement in the left and right side ears, respectively, each of which incorporates a digital signal processor to which not only the unprocessed audio signal generated by the microphone in the same hearing aid device is supplied, but also the unprocessed audio signal generated by the microphone in the opposite hearing aid device, the latter audio signal from each of the two devices being supplied to the respective opposite device through a bidirectional communication link.

This prior art system can be switched between distinct modes of either full binaural signal processing or performance as a conventional monaural hearing aid, which in one embodiment is done by giving the user the option of disabling the digital signal processor by either physically removing an external digital processing unit or by disabling a digital processor.

In the binaural processing mode of this prior art system no account is taken of the difference with respect to hearing loss and compensation between the two ears and, somewhat generalized, the system could be seen as an advanced digital substitute for the above-mentioned relatively simple binaural compensation using microphones with a pronounced direction dependent characteristic.

SUMMARY OF THE INVENTION

On this background, it is the object of the invention to provide an improved digital binaural hearing aid system in which the above-mentioned shortcomings of prior art systems have been eliminated to provide for a binaural signal processing, which for persons with a binaural hearing loss will restore binaural sound perception while taking into account the difference in hearing loss and compensation between the two ears.

According to the invention, a binaural digital hearing aid system as defined above is characterized in that the digital signal processing means of each unit is arranged to effect a substantially full digital signal processing including individual processing of signals from the input transducer means of the actual unit and simulated processing of signals from the input transducer means of the other unit as well as binaural signal processing of signals supplied, on one hand, internally from the input signal transducer means of the same unit and, on the other hand, via said communication link from the input signal transducer means of the other unit, said digital signal processing means including at least a first digital signal processor part for processing said internally supplied signal, a second digital signal processor part for processing the signal supplied via said communication link and a third digital signal processor part to effect common binaural digital signal processing of information derived from the signals processed in said first and second digital signal processor parts, said second digital signal processor part in each unit simulating the first digital signal processor part in the other unit with respect to adjustment parameters controlling the performance of said first signal processor part in said other unit.

Thereby, in the binaural hearing aid system of the invention each of the hearing aid units for the left and right side ears, respectively, performs in addition to digital signal processing adapted to compensate for the hearing loss of the ear served by the unit, a simulated full digital signal processing of sound signals received by the unit for the opposite ear and adapted to compensate for the specific hearing loss of that ear, as well as a common binaural signal processing taking into account both of the normally different compensation characteristics of both units.

By the advantageous embodiments and modifications of the system set out in the dependant claims the system can be designed for user operated switching between functioning as a binaural system and a conventional monaural hearing system, and the digital signal processing means in each hearing unit may be programmable to be switchable between different sound environments or listening situations by user operation, whereby programmed performance data for the first signal processing means of one unit is entered for programming of the second signal processing mens of the other unit, in which the simulated signal processing of signals supplied from the first unit is carried out.

By the provision of only a single bidirectional communication link between the two hearing aid units, the hearing aid system of the invention is less susceptible to signal distortion and interruption than the prior art systems described above.

BRIEF DESCRIPTION OF THE DRAWINGS

In the following the invention will be further explained with reference to the accompanying drawings on which

DETAILED DESCRIPTION OF THE INVENTION

Figure 1:
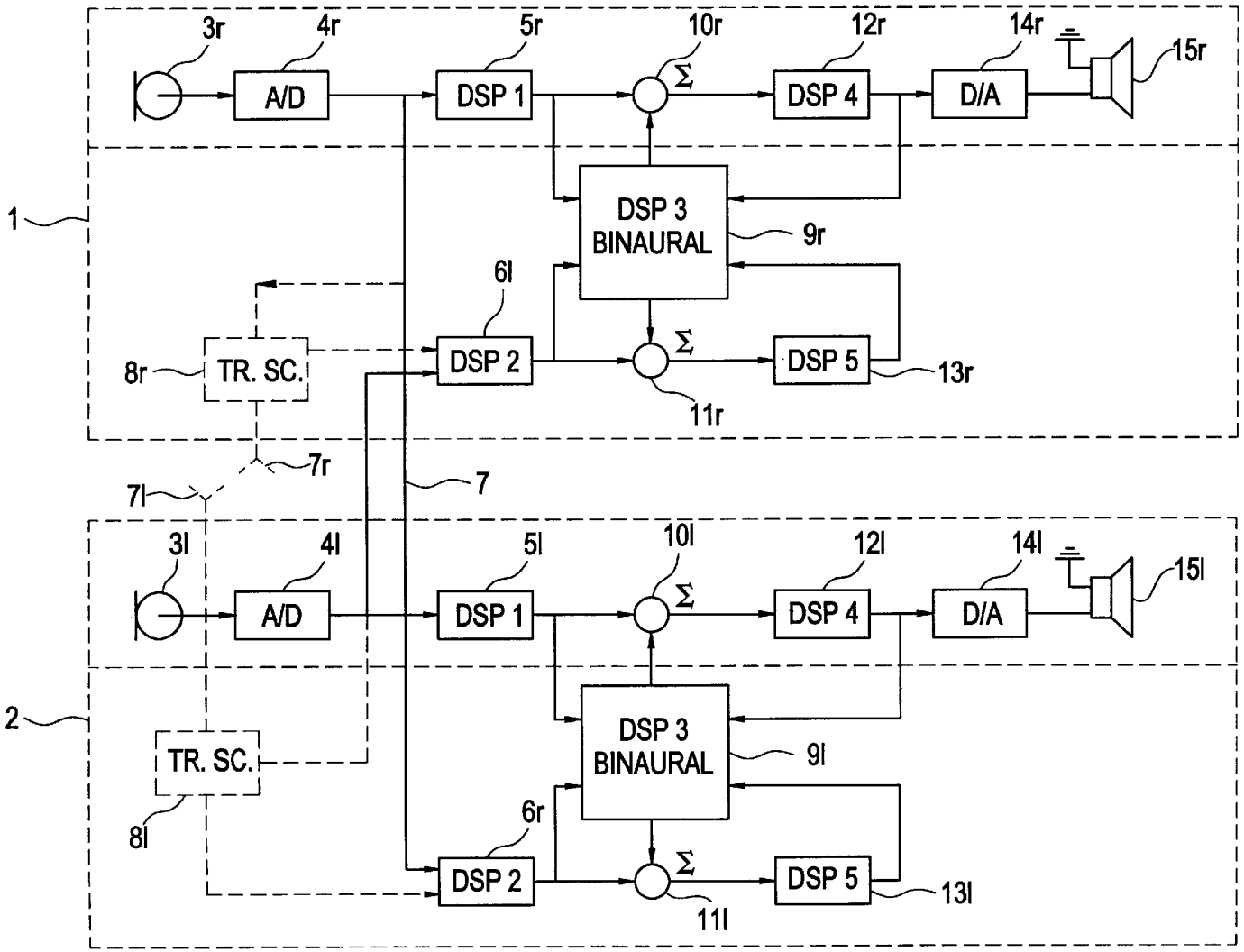
FIG. 1 is a schematic block diagram representation of an embodiment of the hearing aid system of the invention.

The binaural hearing system illustrated in FIG. 1 comprises two hearing aid units 1 and 2 intended for arrangement in the user's right and left ears, respectively. The hearing aid units 1 and 2 are identical in structure, but as further explained in the following they will normally have been programmed or otherwise adjusted to provide different hearing loss compensation adapted to the specific hearing impairment of the ear, in which the unit is to be arranged. For the following description identical parts in the two units 1 and 2 will be designated by the same reference numeral followed by "r" and "l", respectively, to indicate the localization of such parts in either the right ear or the left ear unit 1 or 2.

Each of units 1 and 2 comprises input signal transducer means e.g. in the form of one or more hearing aid microphones 3*r*, 3*l* which receives sound signals to be processed in the unit and transforms these sound signals into analog electrical signals which are supplied to an A/D converter 4*r*, 4*l* for conversion into digital signals.

In the embodiment shown the digital signal from A/D converter 4*r*, 4*l* in each of units 1 and 2 is supplied to a first digital signal processor 5*r*, 5*l* which is programmed or otherwise adjusted to perform signal processing functions such as filtering, band-division, amplification, gain control adjustment, compression, expansion and/or compensation for unlinearities in the microphone or the user's ear channel.

However, to the extent that some of the signal processing functions of processors 5*r*, 5*l* may be implemented in the A/D converters 4*r*, 4*l*, each of which will then supply a preprocessed digital signal, each of digital processors 5*r*, 5*l* need not be present as a separate unit.

According to the invention, each of units 1 and 2 also comprises a second digital signal processor 6*l* and 6*r*, respectively, which is structurally identical to processor 5*r*, 5*l*, but is programmed or otherwise adjusted to perform digital signal processing functions on the signals received by the opposite ear, i.e. processor 6*l* in unit 1 for the right ear is programmed to provide the specific signal processing intended for the left ear and will thus, in principle, provide the same signal processing as signal processor 51 in unit 2, whereas signal processor 6*r* in unit 2 will provide the same signal processing as processor 5*r* in unit 1.

In the embodiment shown the digital electrical signal from converter 4*r*, 4*l* in each of units 1 and 2 is additionally supplied via a communication link 7 to second signal processor 6*r*, 6*l* in the other unit, such that in each unit the second signal processor 6*l*, 6*r* performs a simulated processing corresponding to the processing by first signal processor 5*l*, 5*r* in the other unit. However, as an alternative the analog signals from microphone 3*r*, 3*l* in each of units 1 and 2 could be communicated directly and supplied to A/D conversion in the other unit.

The signal processors 5*r*, 5*l* and 6*r*, 6*l* will typically be state of the art digital hearing aid processors programmed to perform a relatively sophisticated signal processing with respect to sound/noise separation and user operated adaptability to a number of different sound environments or listening situations.

The communication link 7 between the right and left hearing aid units 1 and 2 is preferably a single bidirectional communication link which may be physically implemented by a cable extending between the two units. The hearing aid units 1 and 2 may be designed for arrangement in the ear (ITE) or behind the ear (BTE). In either case a cable connection between the units may extend around the neck of the user and may eventually be integrated in a necklace or similar piece of jewelry or bijouterie.

Alternatively, the bidirectional communication link 7 may be wireless and, as shown in dashed lines,comprise antennas 7*r*, 7*l* connected with appropriate transceiving means 8*r*, 8*l* in each unit. For hearing units in ITE design such an antenna may be physically implemented by a relatively short piece of wire or string which in use will project outside the ear and may serve additionally to facilitate withdrawal of the hearing unit from its ITE position.

In each of units 1 and 2 the first and second digital signal processors 5*r*, 5*l* and 6*l*, 6*r* outputs a processed digital signal which is supplied to a third signal processor 9*r*, 9*l* which, in accordance with the invention performs a common binaural digital signal processing of the processed digital signals outputted from the first and second signal processors 5*r*, 5*l* and 6*l*, 6*r*.

The binaural signal processing in each of third signal processors 9*r*, 9*l* may make use of state of the art binaural processing techniques taking into account differences with respect to amplitude, phase-lag etc. between arrival of incoming sounds at the input transducers of the right and left ear hearing aid units. As result of this binaural signal processing which according to the invention is based on information derived from the processed digital signals in both of units 1 and 2, the third signal processor 9*l*, 9*r* in each unit outputs processed digital right and left binaural signal parts which in digital adder devices 10*r*, 10*l* and 11*l*, 11*r* is combined with the processed digital output signal from first signal processor 5*r*, 5*l* in the same unit.

In each unit the combined processed digital signals from adder device 10*r*, 10*l* may be supplied directly to a D/A converter 14*r*, 14*l* for conversion into a processed analog signal which is supplied to an output transducer device in the form of a conventional hearing aid telephone 15*r*, 15*l*. As illustrated the processed digital signals from adder devices 10*r*, 10*l* and 11*r*, 11*l* may optionally undergo a further digital signal processing in fourth signal processors 12*r*, 12*l* and fifth signal processors 13*r*, 13*l*, respectively, which may include compensation of the specific hearing loss and automatic gain control. From processors 12*r*, 12*l* and 13*r*, 13*l* feedback signals are also supplied to the binaural processor 9*r*, 9*l*.

The processing functions of the fourth and fifth signal processors 12*r*, 12*l* and 13*r*, 13*l* in each of units 1 and 2 may be implemented in the binaural processor 9*r*, 9*l* so that processors 12*r*, 12*l* and 13*r*, 13*l* may in principle be dispensed with as separate units. The binaural signal processor 9*r*, 9*l* may then further be designed to output only the binaural digital signal part intended for the actual unit, i,e, the right ear binaural signal part for unit 1 and the left ear binaural signal part for unit 2. In both cases, the incorporation of the fourth and fifth signal processors either as separate units or in the binaural processor 9*r*, 9*l* provides an advantageous possibility, however, for an AGC function and/or hearing loss compensation in the binaural signal processor 9*r*, 9*l* by feed-back of the processed digital output signals from both of the fourth and fifth signal processors 12*r*, 12*l* and 13*r*, 13*l* to the binaural processor 9*r*, 9*l*.

Examples of digital signal processors for use in each of units 1 and 2 are disclosed e.g. in EP-B1-0 732 036, U.S. Pat. Nos. 5,165,017, 4,531,229 and 5,144,675. An advanced signal processing method and device employing socalled dynamic AGC has been disclosed in copending international patent application PCT/DK97/00598, the disclosure of which is incorporated herein by reference.

The design and structure of the binaural hearing system of the invention, by which all information carrying signals in the separate signal channels for the right ear and the left ear sound perception are made available for processing in both of units 1 and 2 not only of the signal actually belonging to the respective side, but also, by simulated processing, of the signal belonging to the other side, opens the possibility of implementing complex and highly sophisticated binaural signal processing to restore binaural hearing ability without significant complication of the structure. In fact, both of hearing aid units 1 and 2 may be identical in structure and equipped with identical components like converters, signal processors etc.

Whereas the various signal processors in each of units 1 and 2 have been illustrated and described as separate processors they may advantageously be incorporated as separate processing parts of a common single digital processor such as a microprocessor.

Figure 2:
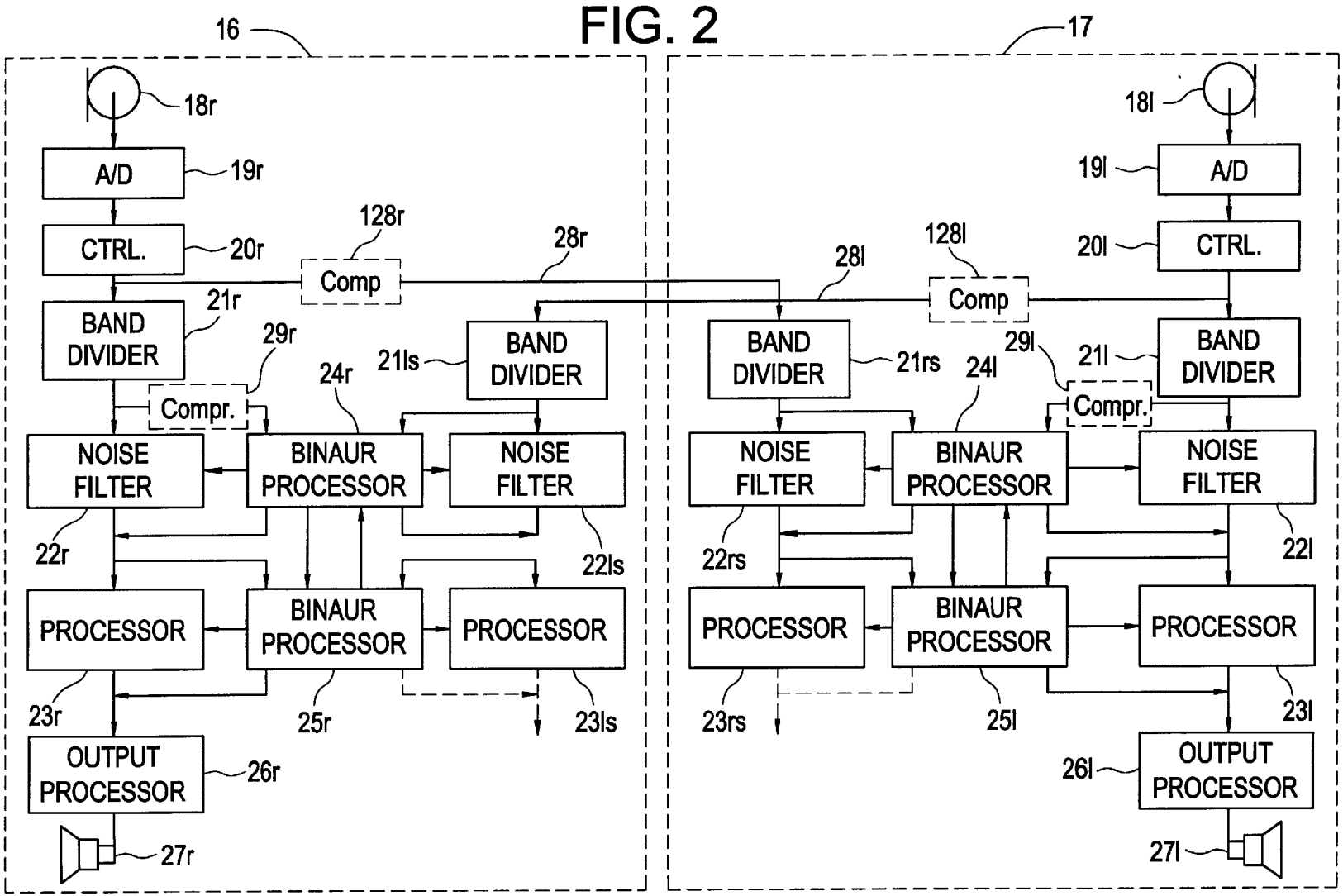
FIG. 2 a further detailed representation of the embodiment shown in FIG. 1.

The embodiment of the hearing aid system shown in FIG. 2 serves to illustrate the degree of complexity of binaural signal processing that can be implemented in each of the right and left ear hearing aid units 16 and 17 with a single bidirectional communication link 28 between the two units.

Using the same distinction as to reference numerals between the right and left ear units as used for the embodiment in FIG. 1 only the structure and function of the right ear unit 16 will be explained in the following.

The unprocessed analog signal from microphone 18*r* is preamplified and converted to digital form in preamplifier and A/D converter 19*r* and processed to compensate for unlinearity of the microphone and the sound perception in the ear in linearity control unit 20*r*, from which a preprocessed digital signal is supplied, on one hand to a band divider filtering unit 21*r* in the signal processing channel for the right ear and, on the other hand, via the bidirectional communication link 28*r* to a band divider filtering unit 21*rs* in the processing part of the left ear unit 17 performing the simulated right ear signal processing.

In the band divider filtering unit 21*r* the incoming preprocessed digital signal is split into a number of frequency bands, each of which is further processed in a noise filtering unit 22*r* and a processing unit 23*r* in which the signal is amplified in accordance with the compensation characteristic adapted to compensate for the specific hearing loss of the right ear.

As for the embodiment in FIG. 1 each of the two hearing aids comprise in addition to the signal processing channel for the ear in which the unit is arranged a separate signal processing channel effecting a simulated signal processing corresponding to the signal processing in the other unit. In the embodiment in FIG. 2 this simulated processing channel comprises for the right ear hearing aid unit 16 processing units 21*ls*, 22*ls* and 23*ls* effecting the same processing functions as processing units 21*r*, 22*r* and 23*r* for the right ear compensation, but adjusted to the specific characteristics for the left ear compensation effected in the left ear hearing aid unit 17.

The left ear hearing aid unit 17 is identical in structure to the right ear hearing aid unit 16 and comprises the left ear signal processing channel with processing unit 19*l* and 20*l* and filtering and compensation units 21*l*, 22*l* and 23*l* as well as the simulated right ear processing channel including units 21*rs*, 22*rs* and 23*rs*.

In each of the hearing aid units 16 and 17 binaural signal processing may be effected in two processing units 24*r*, 24*l* and 25*r*, 25*l*. Thus, in the right ear hearing aid unit 16 a first binaural processing unit 24*r* may receive the band divided output signals from filtering unit 21*r* in the right ear processing channel as well as from filtering unit 21*ls* in the simulated left ear processing channel and provide correction signals affecting signal scaling in processing units 22*r* and 22*ls* and a second binaural processing unit 25*r* may effect further binaural signal processing on incoming signal from the first binaural processing unit 24*r* as well as from processing units 22*r*, 22*ls* and 23*r*, 23*ls*.

Finally, in each of hearing aid units 16 and 17 the output signal from processing unit 23*r*, 23*l* in the right and left ear processing channel, respectively, and the binaural output signal from the second binaural processing unit 25*r*. 25*l* is reconverted into analog form in an output processing unit 26*r*, 26*l* and supplied to an output transducer such as a conventional hearing aid telephone 27*r*, 27*l*.

In each of hearing aid units 16 and 17 all of processing units 22 to 25 may be designed for automatic gain control (AGC), e.g. as disclosed in the above-mentioned copending international patent application PCT/DK97/000598.

In each of the hearing aid units 16 and 17 the processing units 21 to 25 are thus interconnected via a multiplicity of internal information and control signals lines, whereas the only external connection to the other hearing aid unit is via the single bi-directional communication link 28*r*, 28*l*.

According to a particular aspect of the invention the signal lines connecting the processing units 21 to 23 of the right and left ear processing channels and the simulated left and right ear processing channels to the binaural processing units 24 and 25 may be opened and closed or activated and deactivated by control of appropriate switching means, not illustrated, whereby an advantageous adjustment flexibility is obtained with a smooth transition ranging from full binaural signal processing approximating the sound information processing of the human brain via a more simple binaural sound level control to conventional monaural sound reproduction, contrary to the separation of the processing units for normal and binaural processing in the prior art system of WO 97/14268 explained above.

The signals supplied in each of the right and left ear hearing aid units to the binaural signal processing in units 24 and 25 may as illustrated in FIG. 2 be microphone signals which have been preprocessed by conversion into digital form and correction of frequency and/or level distortions caused by unlinearities in the microphone circuits and/or following from the arrangement in the user's ear channel. Preferably, the incoming signals for the binaural processing have been filtered to the desired frequency band width.

Moreover as shown in FIG. 2 the preprocessed microphone signal supplied from each of hearing aid units 16 and 17 to the simulated processing channel of the other unit may be limited, e.g. by compression in an additional compressor unit 128*r*, 128*l*, to reduce the dynamic range, the band width and/or the number of samplings, thereby reducing the amount of data or information to be processed by the simulated processing. A similar signal limitation may also be provided, e.g. by an additional compressor unit 29*r*, 29*l* for the signals supplied in each hearing unit from the signal processing channel for the right or left ear, respectively, to binaural signal processing. In either case the processing units, to which such compressed signals are supplied, must be designed for processing these signals.

The binaural signal processing effected by processing units 24 and 25 may comprise a level correction, by which the gain in the hearing aid unit, right or left, receiving the weakest incoming sound signal is controlled on the basis of the incoming sound signal at the other hearing aid unit as represented, e.g. by the preprocessed microphone signal communicated therefrom via communication link 28 for simulated signal processing. Thereby, the sound level ratio between sounds received by the right and left ears, respectively, and the spatial information provided thereby may be maintained also for hearing aid units with automatic gain control (AGC), sin AGC control can be effected on the basis of the strongest processed signal in the right or left ear units 16 and 17.

The complexity allowed for the internal signal processing in each of hearing aid units 16 and 17 would also allow a compensation for time delays introduced e.g. by the signal communication via communication link 28, if necessary.

For hearing aids which as shown in FIG. 2 employs sound or signal processing in a number of separate frequency bands with automatic gain control in each band the processing complexity and/or capacity further entails a data or information transfer between the real and simulated processing channels in each unit to provide for equal adaptation of the gain control of these processing channels, whereby the overall transfer function of each hearing aid unit may be adapted to take account of sound spectrum differences occurring at the right and left sides, thereby taking account of the frequency distribution in the spectra of sounds received at the right and left ears, which is very important for the localization of a sound source in space.

Since, in each of the right and left ear hearing aid units 16 and 17 in FIG. 2 all processing units 19*r*–23*r*, 19*l*–23*l* for the actual right or left ear signal processing channel and all processing units 21*ls*–23*ls*, 21*rs*–23*rs* for the simulated signal processing channel are programmed or otherwise adjusted to the specific processing parameters for the right and left ear signal processing, respectively, or vice versa, the binaural signal processing in each side takes fully account of the specific hearing loss characteristics of both sides up to or even beyond the output signal transducer 26*r* and 26*l*, respectively.

To accomplish this the binaural signal processing effected in the right and left ear hearing units 16 and 17 will typically be mirror images of each other to restore the actual sound level and sound spectrum differences between incoming sounds at the right and left ears, respectively.

As a special advantage of the binaural signal processing in each of the two hearing units of the system according to the invention a sophisticated noise or feedback suppression is made possible, by which tone signals deviating from the overall sound image may be effectively suppressed without suppression of tone signals present in the overall sound signal or in the right and left side at the same time. This can be accomplished by including in the binaural sound processing unit a feedback suppression system to which a residual feedback signal representing the difference feedback signals from the actual and simulated sound processing channels is supplied. By means of such a feedback suppression it is possible for the hearing aid system of the invention to distinguish between howl and information sound signals of a similar character such as a tone from a flute solo in classical music composition or alarm or signalling tones such as walk/stop beeps at traffic lights.

In each of hearing aid units 16 and 17 the performance of each of signal processing units 21*r*–23*r*, 21*l*–23*l* in the real signal processing channel as well as the performance of each of the processing units 21*ls*–23*ls*, 21*rs*–23*rs* in the simulated processing channel is controlled by adjustment parameters or data adapted to the specific compensation requirements of the right and left ears, respectively.

According to the invention such adjustment parameters may be individually programmable to compensate for the user's specific hearing impairment with respect to the right and left ears, whereby the hearing aid system may be supplied with a standard adjustment to permit individual programming to be effected by a hearing aid fitter as is customary practice in the individual user adjustment of hearing aids.

Moreover, the adjustment parameters may be organized in different programme settings to permit operation of the hearing aid system in different modes ranging from fully binaural to simple monaural operation of the hearing aid units and/or permit adaption of the hearing aid system to varying sound environments or listening situations.

Figure 3:
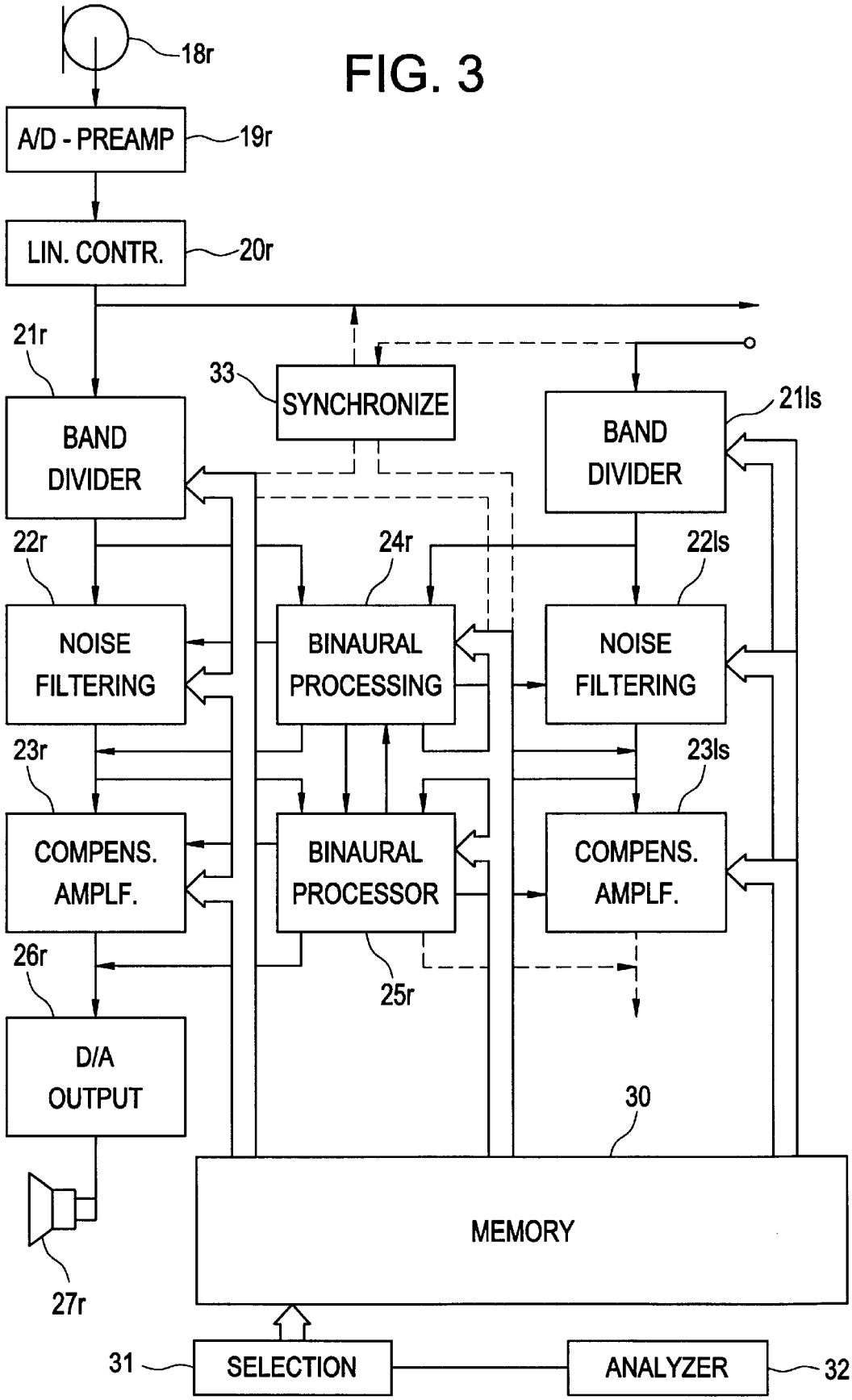
FIG. 3 is a block diagram representation of one hearing aid unit of a programmable hearing aid system of the invention.

FIG. 3 shows for one of the hearing aid units in the system illustrated in FIG. 2, i.e. The right ear hearing aid unit 16 how this is accomplished by means of a performance and programme memory 30 in which all programmable adjustment parameters for a number of specific performance programmes are entered and may be selected from a selection unit 31 which may be user operated and/or operated from a sound signal analyzer 32 to effect programme selection automatically in response to occurrence of specified sound signal conditions.

Optionally, at least one of hearing aid units 16 or 17 may include means for calculation of intermediate settings between at least two consecutive performance programme settings, in which case also such intermediate settings will be selectable from the selection unit 31.

Since as a result of the structure and organization of hearing aid units 16 and 17 to effect not only the actual signal processing for the ear in which the unit is arranged, but also the simulated processing for the opposite ear memory 30 will contain all adjustment parameters needed for the signal processing for both sides, the programming of the hearing aid system may be effected by entering of adjustment parameters and user operated or automatically activated performance programmes in memory 30 of the one of hearing aid units 16 and 17 only and effecting transfer of adjustment parameters for the processing units of the other hearing aid unit via the communication link 28 in an adjustment or initiation mode activated at each change of performance programme.

Ultimately this makes possible to operate the system according to the invention by a master-slave principle, in which case one of the hearing aid units would function as a master unit and take control of the other unit functioning as a slave unit in which memory 30 would then contain the information or parameters needed for the actual function of the slave unit.

Alternatively, various kinds of intermediate or mixed organization schemes could be foreseen, e.g. by designing both hearing units with user operated as well as automatic programme selection. This could provide e.g. for consensus operation in situations where one unit would try to shift automatically to a specific programme matching prevailing sound signal conditions, by effecting an exchange of actual adjustment parameter settings between the two units via communication link 28 to enable a decision to be made in one of the units as to whether the programme selected by one of the units should be effected for both units.

In each of the two units synchronization means 33 may further be provided for the exchange of synchronization information between the signal processing parts of the two units via the communication link 28. Such synchronizing information may be derived from the signals otherwise transferred between the two units or be generated as separate synchronizing signals.

User operability may advantageously be effected by wireless remote control from a separate control unit carried by the user. This is suitable, in particular, for embodiments in which wireless transmission is already used for the bidirectional communication link between the two hearing aid units.

We claim:

1. A binaural digital hearing aid system comprising two hearing aid units for arrangement in a user's left and right ear, respectively, each of said units comprising input signal transducer means for conversion of a received input sound signal into an analog input signal, A/D conversion means for conversion of said analog input signal into a digital input signal, digital signal processing means for processing said digital input signal and generating a digital output signal, D/A conversion means for conversion of said digital output signal into an analog output signal and output signal transducer means for conversion of said analog output signal into an output sound signal perceivable to the user, a bidirectional communication link being provided between said units to connect a point in the signal path between the input signal transducer means and the digital signal processing means in one of said units with a corresponding point in the signal path between the input signal transducer means and the digital signal processing means of the other of said units, characterized in that the digital signal processing means of each unit (1, 2; 16, 17) is arranged to effect a substantially full digital signal processing including individual processing of signals from the input transducer means (3*r*, 3*l*; 18*r*, 18*l*) of the respective unit and simulated processing of signals from the input transducer means of the other unit as well as binaural signal processing of signals supplied, on one hand, internally from the input signal transducer means of the same unit and, on the other hand, via said communication link (7; 28) from the input signal transducer means of the other unit, said digital signal processing means including at least a first digital signal processor part (5*r*, 5*l*, 12*r*, 12*l*; 21*r*–23*r*, 21*l*–23*l*) for processing said internally supplied signal, a second digital signal processor part (6*l*, 6*r*, 13*l*, 13*r*; 21*ls*–23*ls*, 21*rs*–23*rs*) for processing the signal supplied via said communication link (28) and a third digital signal processor part (9*r*, 9*l*; 24*r*–25*r*, 24*l*–25*l*) to effect common binaural digital signal processing of information derived from the signals processed in said first and second digital signal processor parts, said second digital signal processor part (6*l*, 6*r*, 13*l*, 13*r*; 21*ls*–23*ls*, 21*rs*–23*rs*) in each unit simulating the first digital signal processor part (5*l*, 5*r*, 12*l*, 12*r*; 21*l*–23*l*, 21*r*–23*r*) in the other unit with respect to adjustment parameters controlling the performance of said first signal processor part in said other unit.

2. A hearing aid system as claimed in claim 1, characterized in that said bidirectional communication link (7) is a wireless transmission link, transceiving means (8*r*, 8*l*) and antenna means (7*r*, 7*l*) being provided in each of said hearing aid units.

3. A hearing aid system as claimed in claim 2, characterized in that said antenna means (7*r*, 7*l*) in each hearing unit comprises a short piece of antenna wire, which also provides a withdrawal string.

4. A hearing aid system as claimed in claim 1, characterized in that in at least one of said hearing aid units (16, 17) adjustment parameters for processing units in an actual signal processing channel effecting signal processing adapted to the ear in which the unit is arranged as well as further adjustment parameters for a simulated signal processing channel effecting said simulated signal processing adapted to the ear in which the other unit is arranged are entered into a memory (30).

5. A hearing aid system as claimed in claim 4, characterized in that said memory (30) further includes performance programme settings to provide varying operation modes ranging from fully binaural signal processing to simple monaural signal processing in the hearing aid units and/or provide adaption of system performance to different sound environments or listening situations.

6. A hearing aid system as claimed in claim 5, characterized in that at least one of said hearing aid units (1, 2; 16, 17) include means for calculation of intermediate settings between at least two consecutive performance programme settings.

7. A hearing aid system as claimed in claim 5, characterized in that a programme selection means (31) for said performance programme settings including said intermediate settings is user operated and/or automatically activated on the basis of incoming sound signal analysis.

8. A hearing aid system as claimed in claim 7, characterized in that said program selection means (31) is remotely controlled by wireless transmission of control signals.

9. A hearing aid system as claimed in claim 5, characterized in that said memory (30) is provided in one hearing aid unit only acting as a master unit, said bidirectional communication link (28) being designed for transfer of program settings from said one unit to the other unit acting as a slave unit.

10. A hearing aid system as claimed in claim 7, characterized in that each of said hearing aid units (16, 17) is provided with said memory (30) and said programme selection means (31), said program selection means (31) being designed in both units for user operation as well as automatic activation, said bidirectional communication link (28) being designed for exchange of parameter settings between the two units and one of the units including decision means to provide for a consensus control of the system.

11. A hearing aid system as claimed in claim 1, characterized in that the binaural signal processing functions in each of the two hearing aid units are mirrored with respect to the binaural signal processing functions in the other unit to take account of sound level and/or sound spectrum differences between incoming sound signal at the right and left ear hearing aid units.

12. A hearing aid system as claimed in claim 11, characterized in that the binaural signal processing part of each of said hearing aid units comprises a feedback howl suppression system providing howl suppression by processing of a residual signal representing the difference between feedback signals in the actual and simulated signal processing channels.

13. A hearing aid system as claimed in claim 1, characterized in that limitation means are provided in each of the hearing aid units.

14. A hearing aid system as claimed in claim 1, characterized in that means (33) are provided in each of the two hearing aid units for exchange of synchronization information between the signal processing parts of the two units.

15. A hearing aid system as claimed in claim 13, characterized in that said limitation means comprises means for compression of the signals supplied from said first and second processor parts to said third processor part.

16. A hearing aid for arrangement in an ear of a hearing impaired person, comprising a microphone for converting a sound input into an electric input signal, an A/D converter for converting the electric input signal into a digital input signal, a link for bi-directional communication with another hearing aid for arrangement in a respective opposite ear of the person, a digital signal processor including a first processor part for processing said digital input signal in order to provide a hearing loss compensation for the respective ear of the user, a second processor part for receiving via said link an input signal from said other hearing aid and for effecting signal processing adapted to provide simulated hearing loss compensation for the respective opposite ear of the user, a third processor part for effecting binaural digital signal processing of information derived from the signals processed in said first and second processor parts to provide a digital output signal, a D/A converter for converting the digital output signal into an analog output signal and an output signal transducer for converting the analog output signal into an output sound signal.

17. The hearing aid according to claim 16, wherein said bi-directional communication link comprises a wireless transceiver and an antenna.

18. The hearing aid according to claim 16, comprising a memory for storing performance program settings for said first processor part as well as for said second processor part in order to provide various operation modes ranging from fully binaural signal processing to simple monaural signal processing.

19. The hearing aid according to claim 18, wherein said memory stores performance program settings to provide adaptation of system performance to different sound environments.

20. The hearing aid according to claim 18, comprising an automatic program selection means for selecting among said performance program settings on the basis of incoming sound signal analysis.

21. The hearing aid according to claim 16, wherein said bi-directional communication link is designed for exchange of parameter settings.

22. The hearing aid according to claim 16, wherein said bi-directional communication link is designed for exchange of synchronization information.

23. The hearing aid according to claim 16, wherein said third processor part comprises a feedback howl suppression system providing howl suppression by processing of a residual signal representing the difference between feedback signals in the first processor part and in the second processor part.

24. The hearing aid according to claim 16, wherein said signal processor comprises means for compensating for time delay introduced by the signal communication via said link.

* * * * *